United States Patent [19]

Brown

[11] Patent Number: 4,618,140

[45] Date of Patent: Oct. 21, 1986

[54] PHYSICAL EXERCISING APPARATUS

[76] Inventor: Peter L. Brown, 226 Springfield Road, Chelmsford, Essex, England

[21] Appl. No.: 675,343

[22] Filed: Nov. 27, 1984

[30] Foreign Application Priority Data

Nov. 30, 1983 [GB] United Kingdom ..... 8331900
Nov. 30, 1983 [GB] United Kingdom ..... 8332027

[51] Int. Cl.[4] ..... A63B 69/06

[52] U.S. Cl. ..... 272/72; 272/130; 272/DIG. 4

[58] Field of Search ..... 272/72, 130, 134, 136, 272/70, 900, 103, 117, 131, 132, 142, 143, DIG. 4

[56] References Cited

U.S. PATENT DOCUMENTS

| | | | |
|---|---|---|---|
| 1,910,080 | 5/1933 | Austin | 272/103 |
| 3,586,322 | 6/1971 | Kverneland | 272/72 |
| 3,633,907 | 1/1972 | Cane . | |
| 3,792,860 | 2/1974 | Selnes | 272/70 X |
| 4,157,179 | 6/1979 | Ecklor | 272/67 |
| 4,241,915 | 12/1980 | Noble | 272/144 |
| 4,275,882 | 6/1981 | Grosser et al. | 272/130 X |
| 4,293,127 | 10/1981 | Dudley | 272/900 X |
| 4,397,462 | 8/1983 | Wilmarth | 272/134 X |
| 4,465,274 | 8/1984 | Davenport | 272/134 X |
| 4,477,071 | 10/1984 | Brown et al. | 272/130 X |

FOREIGN PATENT DOCUMENTS

| | | | |
|---|---|---|---|
| 2347029 | 3/1974 | Fed. Rep. of Germany | 272/72 |
| 2396560 | 3/1979 | France | 272/103 |
| 8101662 | 6/1981 | Int'l Pat. Institute | 272/130 |
| 1326263 | 8/1973 | United Kingdom . | |
| 2037593 | 7/1980 | United Kingdom . | |
| 2120560 | 12/1982 | United Kingdom . | |

*Primary Examiner*—Richard J. Apley
*Assistant Examiner*—Robert W. Bahr

[57] ABSTRACT

Physical exercising apparatus comprising a first part adapted to be mounted generally vertically, a second part having a track and a user support movable horizontally along the track, an assembly adapted to be detachably secured in turn to the first part and to the second part and having a carrier member, preferably having a channel section body, on which is mounted a handle and a device for resisting movement of the handle, whereby so called wall exercises can be performed when the assembly is secured to the first part and so called rowing exercises can be performed when the assembly is secured to the second part. The detachable assembly preferably comprises a lever pivotally mounted on the carrier member, the handle being mounted on the lever. The device for resisting movement of the handle preferably comprises a piston and cylinder device pivotally mounted on the carrier and an adjustable fastener connecting the piston and cylinder device to the lever.

15 Claims, 6 Drawing Figures

PHYSICAL EXERCISING APPARATUS

The invention relates to physical exercising apparatus and more particularly but not exclusively to exercising apparatus intended for use in the home to provide a balanced range of exercise.

Modern living practices particularly the western mode of living have given rise to an enormous increase in obesity and in cardio-vascular disease. In recent times both the medical profession and the general public have recognised the importance of physical fitness and the avoidance of tobacco and modern over-processed food to general health well being and the avoidance of the so-called modern diseases. Because of this awareness of the desirability of physical fitness there has been a marked growth in the manufacture and use of exercising equipment for home use.

Such exercising equipment would ideally provide a programme of exercises to fulfil two separate and distinct requirements. The first of these is a simple whole body exercise which is intended for easy repetition over an extended period with the object of stimulating heart and lung activity by raising breathing and pulse rates. Such exercise is now known as aerobic exercise, a term first used by Dr. Kenneth Cooper in the 1960's. Dr. Cooper was responsible for developing a fitness programme for American astronauts and airmen. The types of exercise apparatus most commonly used for aerobic purposes in the home are rowing machines, cycling machines and joggers or similar devices to allow a running action on the spot.

The second basic requirement for home user exercise equipment is the ability to provide a balanced range of exercise for the various body sections and muscle groups to strengthen and improve them for sporting fitness and aesthetic reasons. The main requirements here are for the provision of the exercises known as press exercises in both a lying position, the so called bench press, and in the standing position, the so called shoulder press, to develop the pectoral muscles, the triceps, the chest and the back, the exercise known as curls for developing the biceps, shoulders and chest and the exercise known as squats for legs and thighs.

Currently available home user exercise equipment is limited when judged against these criteria. Wall mounted weight operated rack systems based on professional gymnasium equipment are bulky in use and are heavy, thus expensive to transport. In addition they do not permit a simple repetitive whole body aerobic exercise, Home cycles provide mainly aerobic exercise without fulfilling the other major criterion. Home cycles are now available in which the handle bars convert to enable the device to be used to perform rowing exercise. However, a position sitting on a bicycle saddle is not conductive to satisfactory use of the apparatus in a rowing mode and the equipment lacks all round versatility. Rowing machines are now available which are capable of being placed in an alternative vertical position to give a separate range of body exercises apart from the aerobic rowing exercises. These machines more closely approach the fulfilment of the above mentioned two criteria but are to some extent limited by the vertical height of the frame of the machine which therefore only allows a restricted form of the important squat exercise to be performed.

It is an object of the invention to provide a simple exercising apparatus more particularly but not exclusively for home use which is capable of being used as a rowing machine to provide aerobic exercise and which is capable of being used to perform a further range of exercises which will give a balanced programme of exercise for the whole body which range includes the exercises of bench press, shoulder press, curls and squats.

According to the invention there is provided physical exercising apparatus comprising a first part adapted to be mounted generally vertically, a second part, preferably at least partly floor supported having a track and a user support movable longitudinally along the track, an assembly adapted to be detachably secured in turn to the first part and to the second part and having a carrier member on which is mounted a handle and means for resisting movement of the handle, whereby so called wall exercises can be performed when the assembly is secured to the first part and so called rowing exercises can be performed when the assembly is secured to the second part. Preferably the assembly comprises a lever pivotally mounted on the carrier member, the handle being mounted on the lever.

The means for resisting movement of the handle may comprise a piston and cylinder device pivotally mounted on the carrier and means connecting the piston and cylinder device to the lever. The means connecting the piston and cylinder device to the lever is preferably adjustable to alter the position at which the lever is connected to the piston and cylinder device to vary the effective resistance.

Preferably means is provided for enabling the position of attachment of the carrier on the first part to be vertically adjustable. Thus for example the first part may comprise a generally vertical track with which the carrier is arranged for engagement so as to be slidable therealong, and clamping means for locking the carrier to the generally vertical track in any one of a plurality of positions. Alternatively the carrier could be secured to the first part by pins passing through aligned holes in the respective parts.

Preferably the carrier comprises a body of channel section whereby the lever can be pivotally mounted between the pair of flanges of the channel section body.

The channel section body may be an extrusion or a metal pressing. The resistance means is preferably a piston and cylinder device which is pivotally mounted between the pair of flanges of the channel section body.

Particularly where the channel section body is an extrusion it may be formed with an oppositely directed longitudinally extending pair of flanges which are adapted to engage in corresponding recesses in guideways in the first and second members respectively so that the carrier member can be removably secured in position on the first and second members.

The invention is diagrammatically illustrated by way of example in the accompanying drawings, in which.

Figure 1:
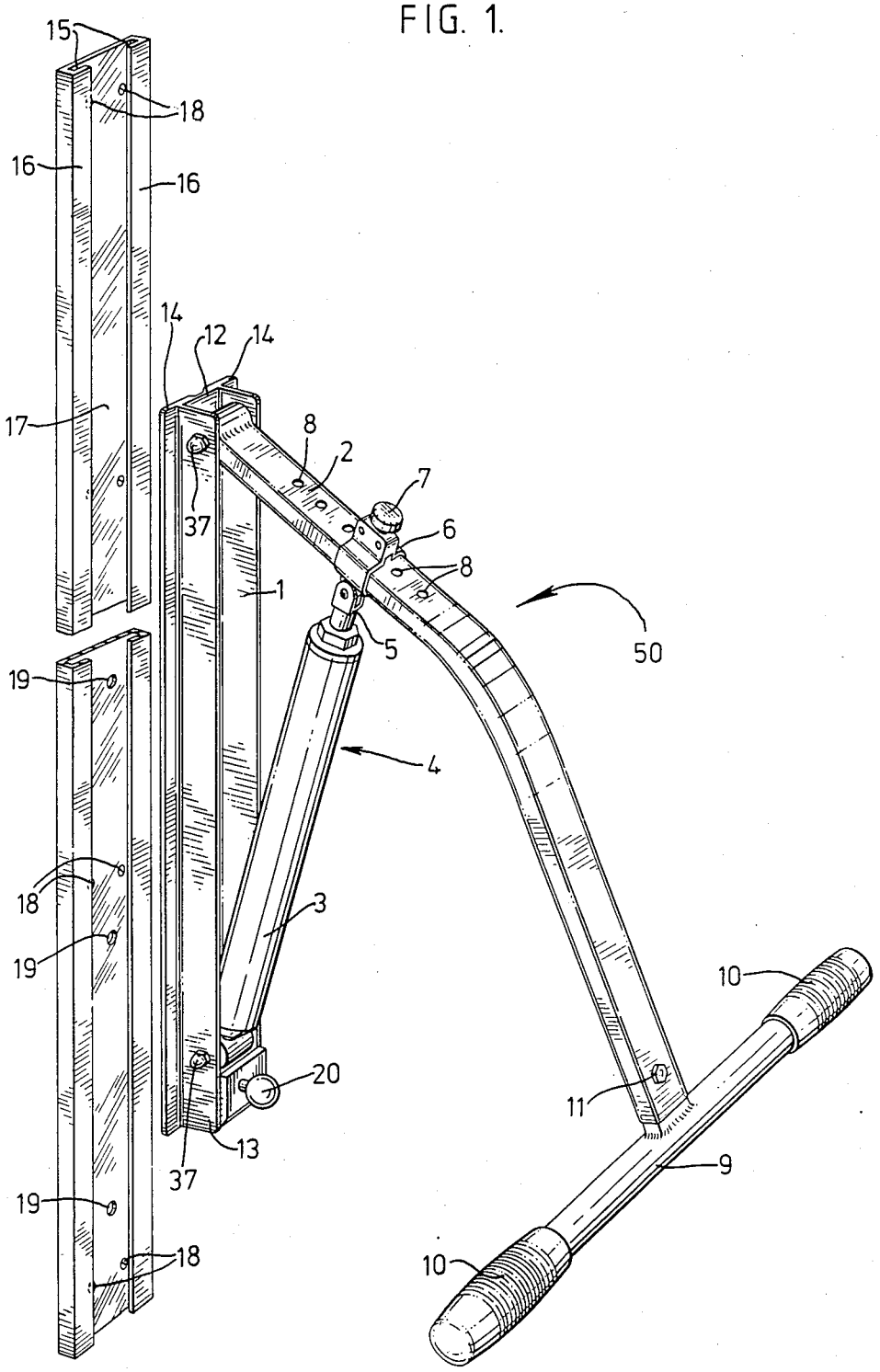
FIG. 1 is a perspective view of the exercising apparatus and showing the components necessary for wall exercise.
Figure 2:
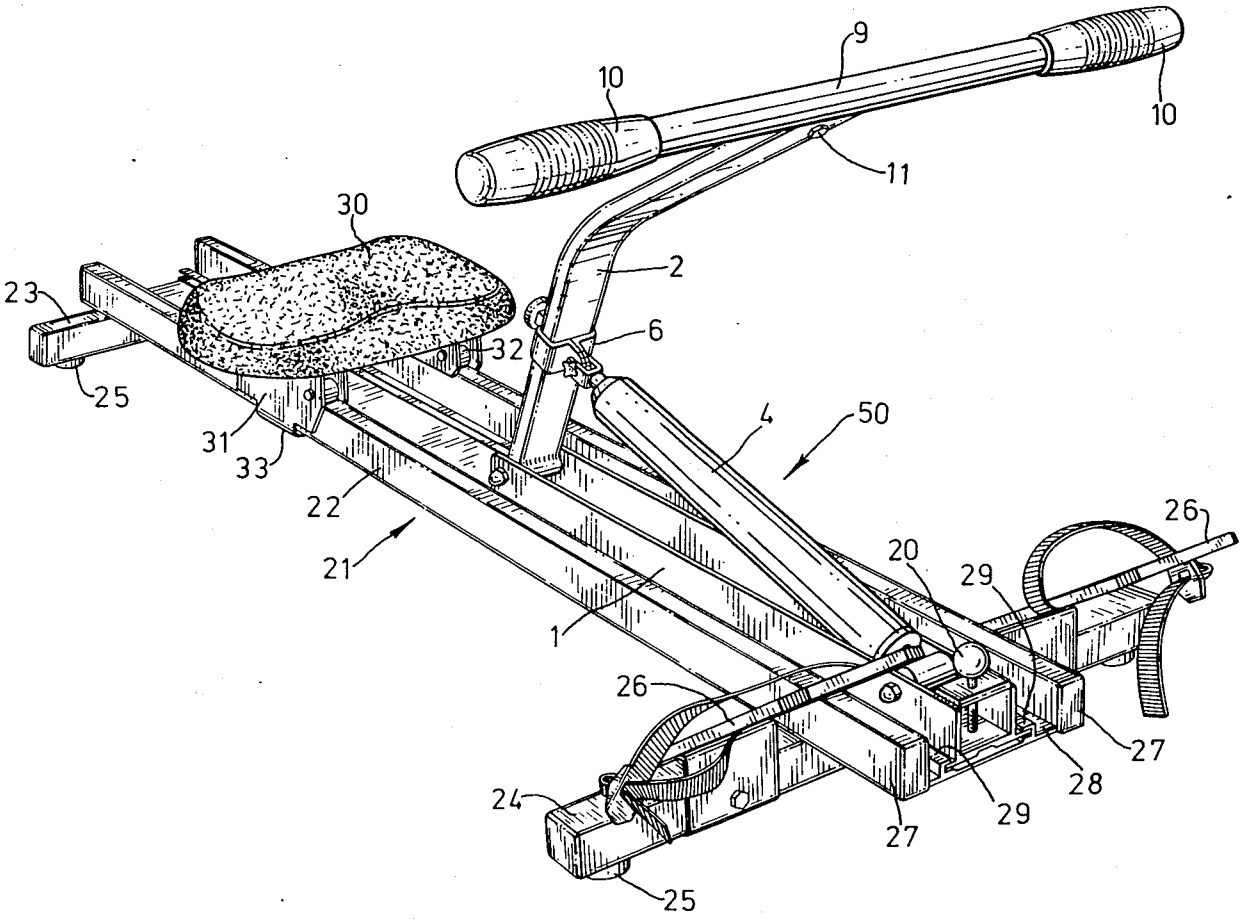
FIG. 2 is a perspective view of the exercising apparatus of FIG. 1 and arranged for rowing exercise.
Figure 3:
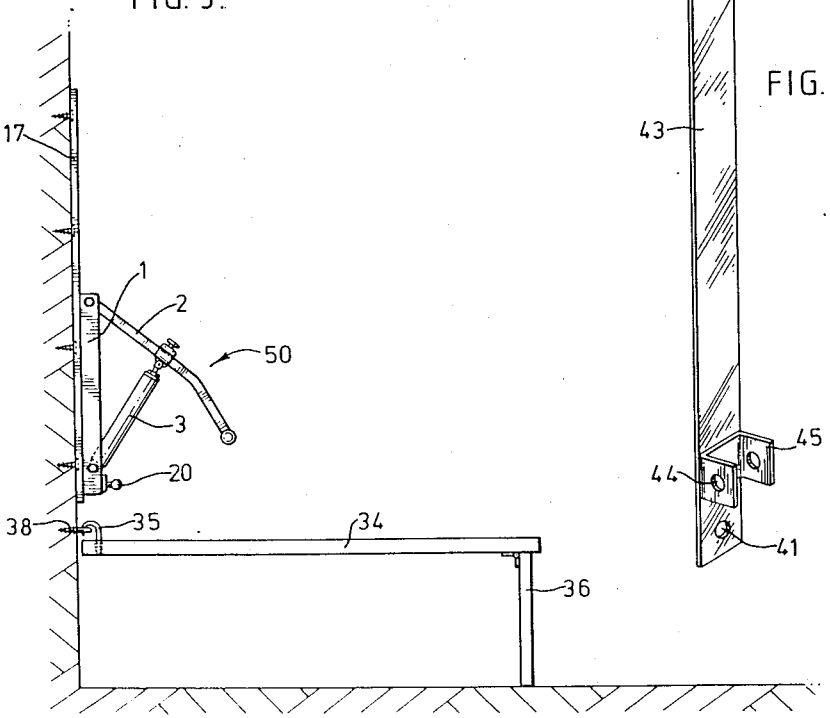
FIG. 3 is a side view of the exercising apparatus of FIGS. 1 and 2 and arranged for wall and bench exercise.

In the drawings, referring more particularly to FIGS. 1 to 3, exercising apparatus comprises an assembly generally indicated by reference numeral 50 and comprising carrier member 1 of channel section, near one end of which is pivotally mounted a lever 2 and near the other end of which is pivotally mounted the cylinder 3 of a piston and cylinder device generally indicated by the reference numeral 4. The piston rod 5 of the piston and cylinder device 4 is connected to the lever 2 at a position intermediate its ends by means of a slidable fastener 6 which embraces the lever. The position of the slidable fastener 6 on the lever 2 can be altered by means of a spring-loaded pin 7 on the fastener 6 which can be engaged selectively with one of a plurality of holes 8 provided in the lever. In this way the effective resistance to movement of the lever provided by the piston and cylinder device 4 can be varied. The free end of the lever 2 is provided with a handlebar 9 formed at its opposite ends with handles 10. Preferably the handlebar 9 is arranged to be detachably secured to the lever 2 by means of a bolt 11 for transport purposes and to permit the handlebar 9 to be replaced by alternative handles of different shape.

In the embodiment illustrated in FIGS. 1 to 3 of the drawings the carrier 1 is a generally U-shaped extrusion, e.g. of aluminium, having a base member 12 from which extend a parallel pair of flanges 13 between which the lever 2 and the cylinder 3 are pivotally mounted on pins 37 which may take the form of nuts and bolts. The base member 12 is extended laterally from the flanges 13 to form an oppositely disposed pair of flanges 14 which are arranged for engagement in corresponding slots 15 defined by flanges 16 in a vertical track 17 which is arranged to be mounted vertically, e.g. by securing the track to a wall. In the interests of clarity the carrier member 1 is shown displaced away from the track 17 in FIG. 1.

The track is formed at intervals with pairs of apertures 18 through which screws may be passed in order to secure the track 17 to a wall. The track 17 is also formed at intervals along its length with apertures 19 so that the carrier member 1 may be fixed in position on the track 17 by means of a spring-loaded detent 20 mounted on the carrier and engageable selectively with any one of the plurality of holes 19. In this manner the height of the carrier member can be adjusted.

Referring to FIG. 2 of the drawings the carrier member 1 with its associated lever 2, handlebar 9, and piston and cylinder device 4 is shown mounted on a rowing machine generally indicated by the reference numeral 21. The rowing machine comprises a main body member 22 supported near both ends by cross members 23, 24 respectively formed on their under sides with ground-engaging feet 25. The cross member 24 carries a pair of foot rests 26.

The body 22 comprises a spaced parallel pair of box section members 27 united at their lower edge by a web 28 formed on its upper surface with an opposed pair of flanges 29 which define slots, similar to those referenced 15 defined by the flanges 16 of the track 17, into which can be slid the opposed flanges 14 on the carrier 1 so that the carrier can be fixed to the body 21. The carrier 1 is prevented from movement relative to the body 22 by means of the spring-loaded detent 20 which engages in a corresponding aperture in the web 28 of the body 22. If desired the carrier may also be clamped to the body by means of a thumb screw (not shown). The upper surfaces of the opposed pair of box section members 27 form a track along which a seat 30 can slide, the seat being provided for this purpose with a carriage 31 having rollers 32 which engage the top surface of the box section members 27 and with extensions 33 which wrap around the under sides of the box section members 27 to prevent accidental displacement of the seat from the track.

As shown in FIG. 3 of the drawings a bench 34 may form part of the apparatus when used in its upright position, the bench having one end formed with a hook 35 engageable with a corresponding member 38 secured to the wall while the other end of the bench is formed with a ground-engaging leg 36. The bench permits the apparatus to be used for bench exercise as well as wall and rowing exercise. Although as shown in the drawings the bench 34 is plain, it will be appreciated that it could if desired, be formed with means for mounting the carrier, with means for mounting a sliding seat and with foot rests so that rowing exercise can be performed thereon.

Figure 4:
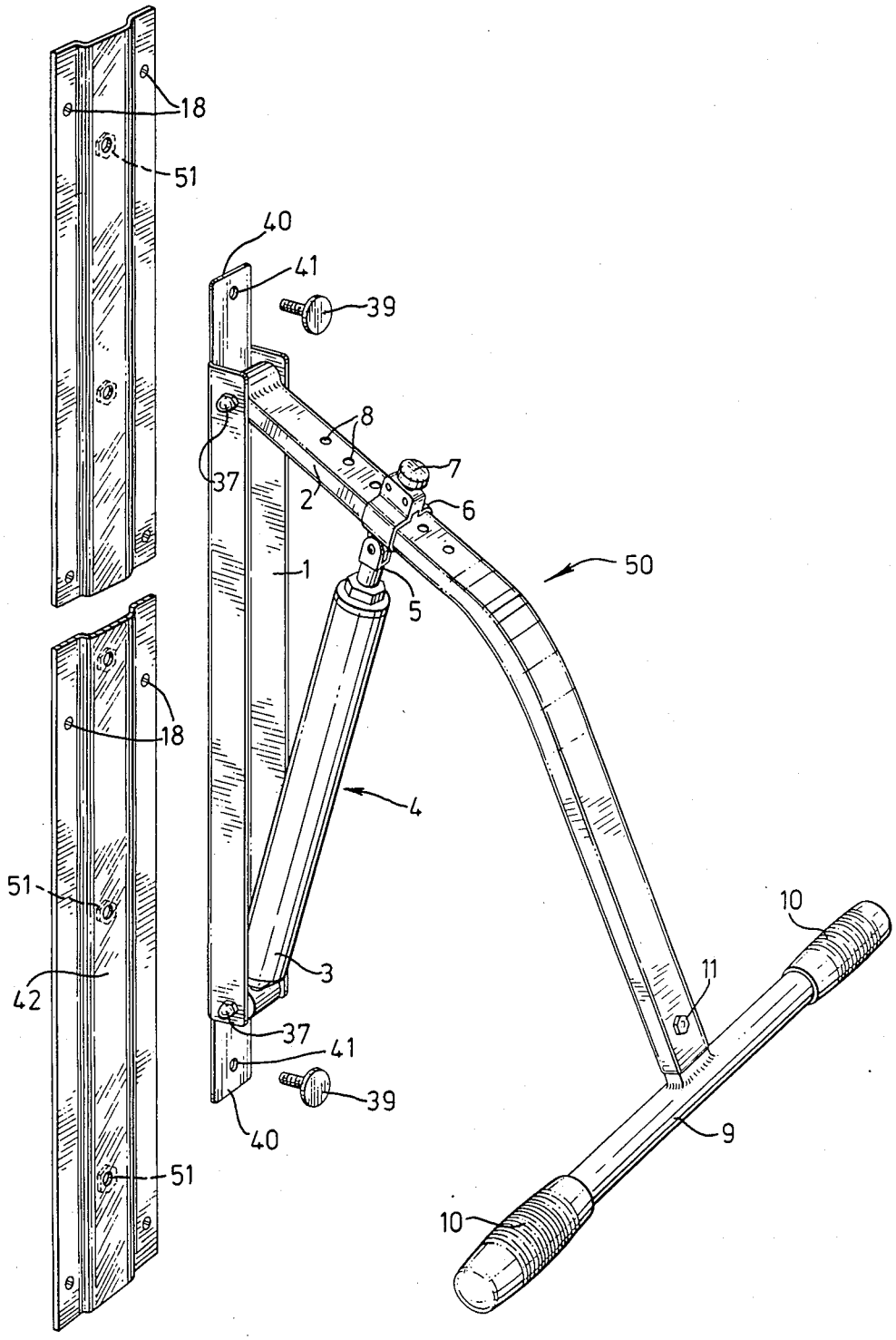
FIG. 4 is a perspective view generally similar to FIG. 1 of a modified form of exercising apparatus.

It will be appreciated that if desired the carrier member could take a configuration other than that shown in FIGS. 1 to 3 of the drawings. For example, the carrier member may be of pressed or rolled metal sheet formed into a U-shape as shown in FIG. 4. In this case, in the absence of the opposed flanges 14, the carrier member is secured in place on a flat wall plate 42 and on the body of the rowing machine 21 by thumb screws 39 which locate in bores 41 in the ends of the carrier member, the thumb screws being fastened in threaded bores in the wall plate 42.

Figure 5:
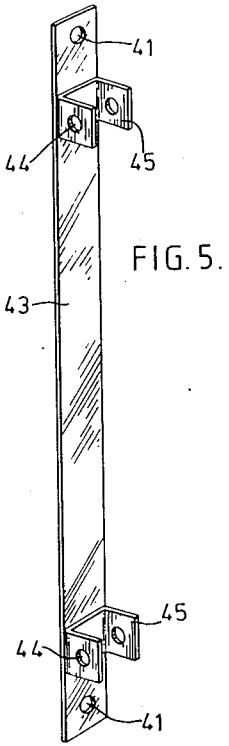
FIG. 5 is a perspective view of an embodiment of a carrier member which forms part of the exercising apparatus of the invention.

FIG. 5 shows an alternative form of carrier member consisting simply of a flat strip 43 formed near each end with bores 41 whereby the carrier member may be fixed in position in similar fashion to that illustrated with reference to FIG. 4. To the flat strip 43 are fixed, e.g. by welding, a pair of U-shaped members 45 formed in their opposite limbs with aligned bores 44 so that the lever 2 and cylinder 4 can be pivoted thereon.

Figure 6:
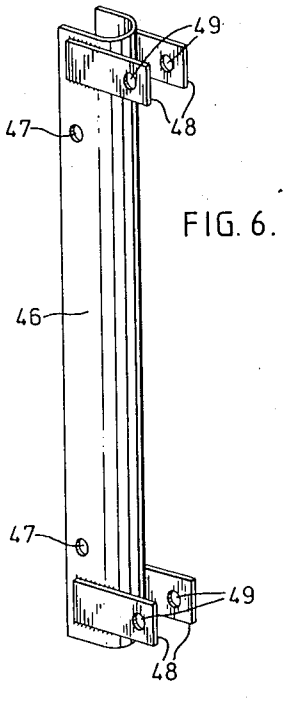
FIG. 6 is a perspective view generally similar to FIG. 5 of a further embodiment of a carrier member which forms part of the exercising apparatus of the invention.

In FIG. 6 the carrier member has a U-shaped body 46 and is inverted so that it can be located on a correspondingly shaped, e.g. tubular member, and releasably fixed thereto, e.g. by pins passing through pairs of apertures 47 in the body 46. Near each end the body 46 is formed with pairs of projecting flanges 48 pierced with apertures 49 so that the lever 2 and cylinder 4 can be pivoted thereon.

I claim:

1. A convertible physical exercising apparatus comprising a first frame structure adapted to be mounted generally vertically; a second frame structure separate from said first frame structure and being randomly located relative to the first frame structure but always oriented substantially perpendicularly to said first frame structure; an assembly separate and independent of said first and second frame structures and having a carrier member, a single lever one end of which is pivotally mounted on the carrier member, a pair of oppositely extending user handles mounted on the other end of the lever and extending substantially transversely thereto, which handles are adapted to be grasped by the user to move the lever, and means on the carrier member engaging the single lever at a position intermediate its ends for resisting pivotal movement of the lever; and means for detachably securing said assembly in turn to said first and second frame structures in orientation substantially perpendicular one to the other whereby wall exercises can be performed when the assembly is secured to the first frame structure and other forms of exercises can be performed when the assembly is secured to the second frame structure.

2. Physical exercising apparatus according to claim 1, wherein the first frame structure is mounted on a wall in vertical orientation in an exercise space defined by walls and the second frame structure is supported on a floor part of said exercise space.

3. Physical exercising apparatus according to claim 1, wherein the means for resisting movement of the handle comprises a piston and cylinder device pivotally mounted on the carrier and means connecting the piston and cylinder device to the lever.

4. Physical exercising apparatus according to claim 3, wherein the means connecting the piston and cylinder device to the lever is adjustable to alter the position at which the lever is connected to the piston and cylinder device to vary the effective resistance.

5. Physical exercising apparatus according to claim 2, comprising means for enabling the position of attachment of the carrier on the first frame structure to be vertically adjustable.

6. Physical exercising apparatus according to claim 5, wherein the first frame structure comprises a generally vertical track and wherein the carrier is arranged for engagement with the generally vertical track so as to be slidable therealong.

7. Physical exercising apparatus according to claim 5, comprising clamping means for locking the carrier to the first frame structure in any one of a plurality of positions.

8. Physical exercising apparatus according to claim 1, wherein the carrier comprises a pair of opposed flanges defining a channel section body.

9. Physical exercising apparatus according to claim 8, wherein the lever is pivotally mounted between the pair of flanges of the channel section body.

10. Physical exercising apparatus according to claim 8, wherein the channel section body is an extrusion.

11. Physical exercising apparatus according to claim 8, wherein the resistance means is a piston and cylinder device which is pivotally mounted between the pair of flanges of the channel section body.

12. Physical exercising apparatus according to claim 8, wherein the channel section body is formed with an oppositely directed longitudinally extending pair of flanges which are adapted to engage in corresponding recesses in guideways in the first and second frame structures respectively so that the carrier member can be removably secured in position on the first and second frame structures.

13. Physical exercising apparatus according to claim 1, cmprising means for locking the assembly to the first and second frame structures, the locking means comprising a pin engageable in corresponding recesses in the carrier and in the respective first and second frame structures.

14. Physical exercising apparatus according to claim 1, comprising a bench which is at least partly floor supported.

15. A convertible physical exercising apparatus comprising a first frame structure adapted to be mounted generally vertically; a second frame structure separate from said first frame structure and being randomly locatable relative to the first frame structure; an assembly separate and independent of said first frame structure and having a carrier member, a single lever one end of which is pivotally mounted on the carrier member, a pair of oppositely extending user handles mounted on the other end of the lever and extending substantially transversely thereto, which handles are adapted to be grasped by the user to move the lever, and means on the carrier member engaging the single lever at a position intermediate its ends for resisting pivotal movement of the lever; and means for detachably securing said assembly in turn to said first and second frame structures in orientations substantially perpendicular one to the other; said first frame structure comprising a generally vertical track, said carrier member when mounted for engagement with the generally vertical track on the first frame structure being vertically slidable therealong, and means on the carrier for locking the carrier member to the first frame structure in any one of a plurality of positions, whereby so called wall exercises can be performed when the assembly is secured to the first frame structure and so called rowing exercises can be performed when the assembly is secured to the second frame structure.

* * * * *